United States Patent [19]

Vanderlaan

[11] Patent Number: 4,600,910

[45] Date of Patent: Jul. 15, 1986

[54] LIMITED ANGLE TORQUE MOTOR WITH HIGH TORQUE OUTPUT MULTIPLE COILS AND INCREASED MAGNETIC CENTERING TORQUE

[75] Inventor: Robert D. Vanderlaan, Kalamazoo, Mich.

[73] Assignee: Pneumo Corporation, Boston, Mass.

[21] Appl. No.: 685,035

[22] Filed: Dec. 21, 1984

[51] Int. Cl.[4] ..... H01F 7/08

[52] U.S. Cl. ..... 335/229; 335/274; 310/36

[58] Field of Search ..... 335/229, 230, 266, 267, 335/272, 274; 310/29, 36

[56] References Cited

U.S. PATENT DOCUMENTS

| | | | |
|---|---|---|---|
| 3,157,803 | 11/1964 | Graydon | 335/229 X |
| 3,214,646 | 10/1965 | Duff | 335/229 |
| 3,234,436 | 2/1966 | Bieger | 310/36 X |
| 3,694,782 | 9/1972 | Ray | 335/230 |
| 4,227,164 | 10/1980 | Kitahara | 310/36 X |
| 4,287,457 | 9/1981 | Takemura | 310/36 X |

*Primary Examiner*—George Harris

*Attorney, Agent, or Firm*—Renner, Otto, Boisselle & Lyon

[57] ABSTRACT

Limited angle torque motor includes a rotor assembly having one or more permanent magnets which are magnetized in the diametrical direction and a stator assembly having a plurality of axially spaced pairs of stator pole pieces, each pair having a stator coil extending circumferentially therearound. Each stator pole piece includes a generally axially extending pole blade and a radially outwardly extending flange portion at one end only of each pole piece, said flange portions being at opposite ends of the pole pieces of each pair. One or more of the stator coils and associated pairs of pole pieces may be rotationally offset with respect to one or more other coils and associated pairs of pole pieces to provide for the reshaping or widening of the resulting magnetic reluctance and interaction of magnetic fields torques versus rotation characteristics for a given motor design. Also, additional magnetic stator pole pieces may be provided at one or both ends of the stator assembly, and the rotor assembly including its permanent magnet(s) may be extended beyond one or both ends of the stator assembly into the additional magnetic stator pole pieces in order to substantially increase the magnetic reluctance torque (centering spring rate) and thus the centering tendency and natural frequency of the motor rotor and output shaft.

16 Claims, 6 Drawing Figures

LIMITED ANGLE TORQUE MOTOR WITH HIGH TORQUE OUTPUT MULTIPLE COILS AND INCREASED MAGNETIC CENTERING TORQUE

BACKGROUND OF THE INVENTION

This invention relates generally as indicated to a limited angle torque motor with high torque output multiple coils and increased magnetic centering torque.

The motor of the present invention relates to certain improvements in limited angle torque motors especially of the type disclosed in applicant's copending U.S. application Ser. No. 579,784, filed Feb. 13, 1984, now U.S. Pat. No. 4,510,403 the disclosure of which is incorporated herein by reference. Such motor is particularly suited for use in certain types of high pressure fluid proportional servo control systems including, but not limited to, aircraft controls to drive a proportional control valve of relatively short stroke. The fluid pressure is normally on the order of 1,000 psi or more.

In such a motor, it would be desirable to be able to significantly increase the output torque capacity and to shape the magnetic reluctance and interaction of magnetic fields torques versus rotation to achieve a specific summation characteristic or widen the useful rotational range of operation of the motor rotor. Also, it would be desirable to increase the magnetic reluctance torque of the motor and thereby increase the centering tendency and natural frequency of the motor rotor and output shaft.

SUMMARY OF THE INVENTION

In accordance with one aspect of the invention, the motor includes a rotor assembly having a plurality of stator coil windings each provided with its own separate pair of stator pole pieces. This permits each pole piece to be made much thinner than if only a single pair of pole pieces were provided for all of the stator coils, thus providing more volume in a given space for increasing the coil windings (ampere turns) and thus the output torque capability of the motor.

In accordance with another aspect of the invention, one or more stator coils and associated pairs of pole pieces may be rotationally offset with respect to one or more other coils and associated pairs of pole pieces, thus permitting some reshaping or widening of the resulting magnetic reluctance and interaction of magnetic fields torques versus rotation to achieve a specific summation characteristic or widen the useful rotational range of operation of the motor rotor.

In accordance with still another aspect of the invention, an additional stator pole piece may be provided at one or both ends of the stator assembly, and the rotor assembly with its permanent magnet may be extended into such additional stator pole pieces to substantially increase the magnetic reluctance torque (centering spring rate) and thereby increase the centering tendency and natural frequency of the motor rotor and output shaft.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
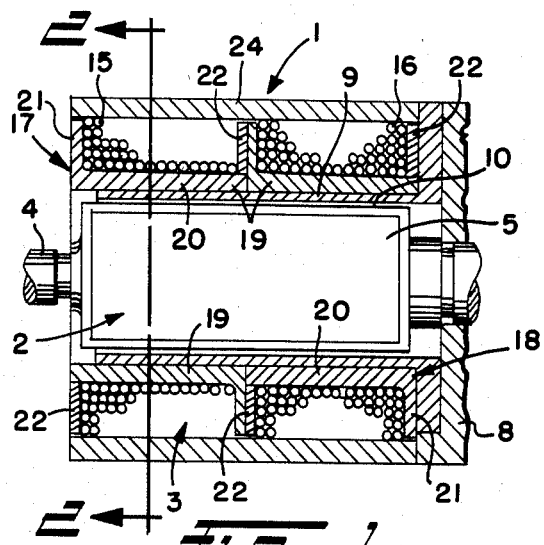
FIG. 1 is a fragmentary longitudinal section through one form of limited angle torque motor in accordance with the present invention.
Figure 2:
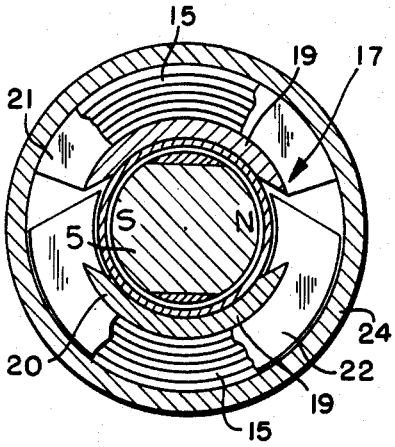
FIG. 2 is a transverse section through the motor of FIG. 1 taken substantially along the plane of the line 2—2 thereof.

Referring now in detail to the drawings, and initially to FIGS. 1 and 2 thereof, one form of limited angle torque motor in accordance with this invention is generally indicated by the reference numeral 1. Preferably, such motor is a non-commutated two-pole stationary coil rotary magnet motor generally of the type disclosed in applicant's aforementioned copending U.S. application Ser. No. 579,784. Such motor desirably consists of two main assemblies, a rotor assembly 2 and a stator assembly 3. The rotor assembly includes a rotor shaft 4 having one or more permanent magnets 5 intermediate the ends thereof. The magnets 5 are magnetized in the diametrical direction, that is, the North and South poles N and S of the magnets are diametrically oriented as shown in FIG. 2. Moreover, the rotor assembly may be suitably mounted for rotation within a motor housing 8 and may be surrounded by a stationary casing or sleeve 9 slightly radially spaced therefrom to provide a flux path clearance 10 therebetween. The rotor casing is in turn surrounded by the stator assembly 3 which desirably includes a plurality of high density layer wound stator coil windings, each having associated therewith its own separate pair of stator pole pieces.

In the FIGS. 1 and 2 embodiment, two such stator coils 15, 16 are shown, whereby there are two separate pairs of stator pole pieces 17, 18. Each pole piece 19 is desirably of the same general configuration, including a generally axially extending pole blade 20 about which the respective stator coils 15, 16 circumferentially extend and a flange or end portion 21 extending radially outwardly from one end only of each stator pole blade. Each stator pole piece is made of a suitable magnetic material such as soft iron, and the stator coils 15, 16 desirably extend around the stator pole blades 20 of the respective pairs of stator pole pieces 17, 18 over substantially the entire length of the stator pole blades. Also, the stator pole pieces of each pair are arranged such that the stator pole flanges of each pair of pole pieces are at opposite ends thereof, whereby when the stator coils are excited by a direct or pulse width modulated current applied thereto, the stator magnetic pole flanges of each stator pole pair will cause a cross or transverse flux through the stator and rotor assemblies which produces a turning torque in the motor.

Figure 3:
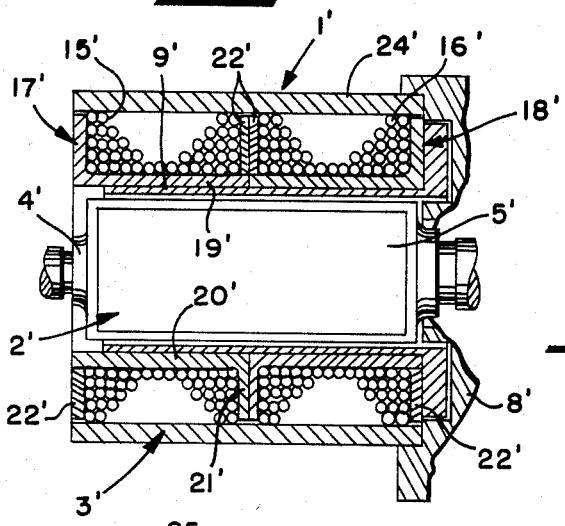
FIG. 3 is a fragmentary longitudinal section through a modified form of limited angle torque motor in accordance with the present invention.

Moreover, the end flanges 21 on the respective pole pieces of each adjacent pair of pole pieces 17, 18 may be facing in the same direction as shown in FIG. 1 or in opposite directions as shown in FIG. 3 as desired. Otherwise, the motor construction of the FIG. 3 embodiment is substantially identical to the FIG. 1 embodiment, and the same reference numerals followed by a prime symbol are used to designate like parts.

At the end of each individual pole piece opposite the respective pole flange is an end plate 22 which may be made of a substantially nonmagnetic material such as non-magnetic aluminum. Such end plates desirably extend circumferentially beyond the opposite sides of the respective pole pieces and terminate adjacent the opposite sides of the other pole piece of each pair and its associated pole flange as seen in FIG. 2. To complete the stator assembly, a magnetic housing 24 made of a suitable magnetic material such as soft iron desirably surrounds the stator coils. Also, the pole flanges 21 desirably extend radially outwardly into contact with the overlapping inner surface of the outer magnetic housing, thus providing a magnetic return path for the magnetic field when the stator coils are excited.

Figure 4:
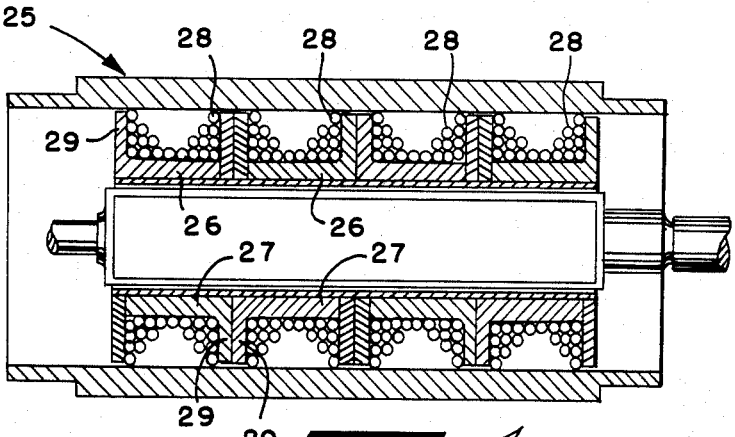
FIG. 4 is a fragmentary longitudinal section through another form of limited angle torque motor in accordance with this invention.

While only two stator coils, and associated pair of stator poles pieces for each coil are shown in FIGS. 1 and 3, it should be understood that such a multiple stator pole piece arrangement can be extended to any number of coils. A four coil design limited angle torque motor 25 is shown in FIG. 4, including two pole pieces 26, 27 for each coil 28, with the end flanges 29 of each pole piece at the opposite ends of each pair of pole pieces, and the respective pole pieces of adjacent pairs of pole pieces facing in the same or in opposite directions as desired. Otherwise, the details of construction and operation of the limited angle torque motor 25 of the FIG. 4 embodiment are substantially the same as that shown in the FIGS. 1 and 3 embodiment.

One advantage in providing such a multiple pole piece structure for the multiple coil windings is that each pole piece can be made much thinner than if a single pair of pole pieces were provided for all of the coil windings, thus allowing more volume in a given space for the coil windings (i.e. more ampere turns) for significantly increasing the output torque capability of the motor. In actual tests, it has been found that when separate pairs of pole pieces are provided for each of a plurality of stator coils, the thickness of the individual pole pieces can be reduced by approximately one-half that of a single pair of pole piece structures for all of the coils.

In addition, such a multiple pole piece structure permits one or more coils and associated pairs of pole pieces to be rotationally offset with respect to one or more other coils and associated pairs of pole pieces, thus permitting some reshaping or widening of the resulting magnetic reluctance and interaction of magnetic fields torques versus rotation characteristics for a given motor design.

The permanent rotor magnet (for example magnet 5 of the FIGS. 1 and 2 embodiment) produces a magnetic flux that develops a magnetic reluctance torque (centering spring rate) that tends to keep the rotor assembly at the midpoint of its rotational angle range.

Figure 5:
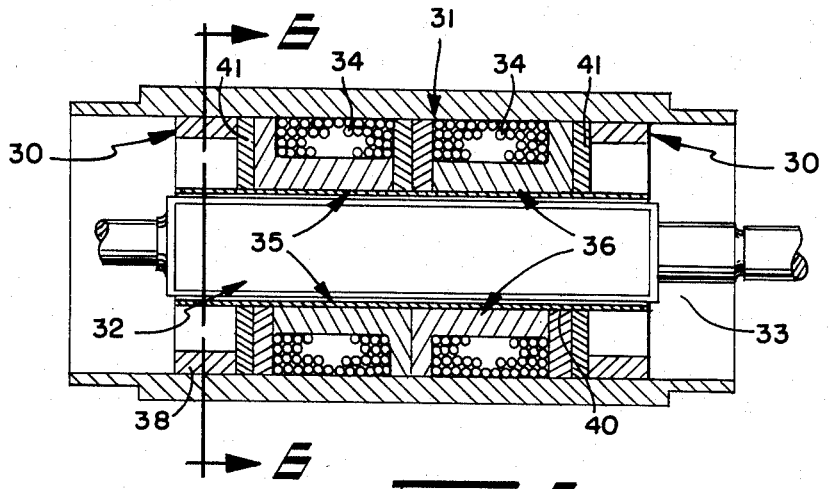
FIG. 5 is a fragmentary longitudinal section through still another form of limited angle torque motor in accordance with this invention.
Figure 6:
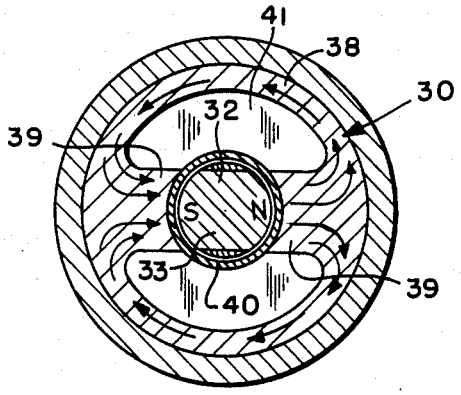
FIG. 6 is a transverse section through the limited angle torque motor of FIG. 5 taken substantially along the plane of the line 6—6 thereof.

In accordance with another aspect of this invention, the magnetic reluctance torque for a given motor design such as illustrated in FIGS. 5 and 6 can be substantially increased by providing an additional magnetic pole piece 30 at one or both ends of the stator assembly 31 and extending the rotor assembly 32 with its rare earth magnet or magnets 33 beyond one or both ends of the stator assembly including its stator coils 34 and associated pairs of stator pole pieces, 35, 36. In FIG. 5 the rotor assembly 32 is shown extended beyond both ends of the stator assembly 31, with an additional magnetic pole piece 30 surrounding each extended end of the rotor assembly. However, it should be understood that the rotor assembly could be arranged to extend beyond only one end of the stator assembly and an additional magnetic pole piece 30 provided only at such one end if desired.

As clearly shown in FIG. 6, each additional magnetic pole piece 30 desirably consists of a solid outer ring portion 38 made of a suitable magnetic material such as soft iron and a pair of diametrically opposed magnetic pole arms or extensions 39 extending radially inwardly from the opposite sides of the outer ring portion into close proximity with the rotor assembly. The inner support sleeve 40 for the stator assembly 31 also desirably extends into the additional magnetic pole pieces 30 to provide additional support therefor, the inner ends of the extensions being shown engaging the outer diameter of the sleeve 40 and having a semi-cylindrical configuration substantially matching the outer cylindrical shape of the support sleeve.

As schematically shown in FIG. 6, the permanent rotor magnet 33 sets up an additional magnetic field through the additional magnetic pole pieces 30 which develops an additional magnetic reluctance torque increasing the centering tendency and natural frequency of the motor rotor and output shaft. A non-magnetic annular spacer 41 may optionally be provided between the additional magnetic pole pieces 30 and adjacent ends of the stator assembly 31 to help isolate these two sections from magnetic interactions that might otherwise degrade performance.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. A limited angle torque motor comprising a rotor assembly and stator assembly, said rotor assembly including a rotor shaft mounted for rotation relative to said stator assembly and a permanent rotor magnet mounted for rotation with said rotor shaft, said permanent rotor magnet being diametrically oriented, and said stator assembly including a plurality of axially arranged stator coils, and a pair of separate stator pole pieces for each coil, said pole pieces of each pair being circumferentially spaced from each other, each said pole piece of each pair comprising a generally axially extending pole blade about which the respective stator coil circumferentially extends, and a radially outwardly extending flange portion at one end only of each said pole piece, said flange portions being at opposite ends of said pole pieces of each pair, whereby when said stator coils are energized by direct or pulse width modulated current, an electromagnetic torque is produced which causes said rotor shaft to rotate through a limited rotational angle range.

2. The motor of claim 1 wherein each of said pole pieces is relatively thin to provide additional room for said stator coils in a given volume for increasng the output torque capability of said motor.

3. The motor of claim 1 wherein the flange portions of the respective pole pieces of adjacent pairs of pole pieces face in the same direction.

4. The motor of claim 1 wherein the flange portions of the respective pole pieces of adjacent pairs of pole pieces face in opposite directions.

5. The motor of claim 1 further comprising a non-magnetic end plate at the end of each pole piece opposite the respective flange portion on each pole piece.

6. The motor of claim 1 wherein one or more of said stator coils and associated pairs of pole pieces are rotationally offset with respect to one or more other stator coils and associated pairs of pole pieces to permit the shaping of the magnetic reluctance and interaction of magnetic fields torques versus rotation of said motor.

7. The motor of claim 1 further comprising an additional stator pole piece at one end of said stator assembly, said rotor assembly including said permanent rotor magnet extending beyond said one end of said stator assembly into said additional stator pole piece, said additional stator pole piece defining a magnetic flux path for said permanent rotor magnet which produces a supplemental magnetic centering spring for said motor tending to keep said rotor assembly at the midpoint of its rotational angle range.

8. The motor of claim 7 wherein said additional stator pole piece comprises an outer magnetic ring portion coaxially disposed around the extended end of said rotor assembly, and a pair of diametrically opposed magnetic pole piece extensions extending radially inwardly from opposite sides of said outer ring portion into close proximity with said permanent rotor magnet.

9. The motor of claim 8 wherein said stator assembly further includes an inner support sleeve coaxially disposed around said rotor assembly for supporting said stator pole pieces around said rotor assembly, there being a flux path clearance between said rotor assembly and said inner support sleeve, said inner support sleeve extending into the center of said additional stator pole piece to provide additional support therefor.

10. The motor of claim 9 wherein the radial inner ends of said pole piece extensions engage the outer diameter of the extended end of said inner support sleeve, said radial inner ends having a generally semi-cylindrical shape corresponding to the cylindrical shape of the extended end of said inner support sleeve.

11. The motor of claim 7 wherein there is an additional stator pole piece at both ends of said stator assembly, and said rotor assembly including said permanent magnet extends beyond both ends of said stator assembly into said additional stator pole pieces.

12. A limited angle torque motor comprising a rotor assembly and stator assembly, said rotor assembly including a rotor shaft mounted for rotation relative to said stator assembly and a perment rotor magnet mounted for rotation with said rotor shaft, said permanent rotor magnet being diametrically oriented, and said stator assembly including one or more stator coils and associated stator pole pieces, and an additional stator pole piece at one end of said stator assembly, said rotor assembly including said permanent rotor magnet extending beyond said one end of said stator assembly into said additional stator pole piece, said additional stator pole piece defining a magnetic flux path for said permanent rotor magnet which produces a supplemental magnetic centering spring for said motor tending to keep said rotor assembly at the midpoint of its rotational angle range.

13. The motor of claim 12 wherein said additional stator pole piece comprises an outer magnetic ring portion coaxially disposed around said one end of said rotor assembly, and a pair of diametrically opposed pole piece extensions extending radially inwardly from opposite sides of said outer ring portion into close proximity with the extended end of said permanent rotor magnet.

14. The motor of claim 13 wherein said stator assembly further includes an inner support sleeve coaxially disposed around said rotor assembly for supporting said stator pole pieces around said rotor assembly, there being a flux path clearance between said rotor assembly and said inner support sleeve, said inner support sleeve extending into the center of said additional stator pole piece to provide additional support therefor.

15. The motor of claim 14 wherein the radial inner ends of said pole piece extensions engage the outer diameter of said inner support sleeve, said radial inner ends having a generally semi-cylindrical shape corresponding to the outer cylindrical shape of said inner support sleeve.

16. The motor of claim 12 wherein there is an additional stator pole piece at both ends of said stator assembly, and said rotor assembly including said permanent rotor magnet extends beyond both ends of said stator assembly into said additional stator pole pieces.

* * * * *